US012528640B2

(12) United States Patent
Polloni et al.

(10) Patent No.: US 12,528,640 B2
(45) Date of Patent: Jan. 20, 2026

(54) RIGID PACK FOR SMOKING ARTICLES PROVIDED WITH A HINGED LID

(71) Applicant: G.D SOCIETA' PER AZIONI, Bologna (IT)

(72) Inventors: Roberto Polloni, Bologna (IT); Luca Paradiso, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 18/698,807

(22) PCT Filed: Oct. 5, 2022

(86) PCT No.: PCT/IB2022/059490
§ 371 (c)(1),
(2) Date: Apr. 5, 2024

(87) PCT Pub. No.: WO2023/057912
PCT Pub. Date: Apr. 13, 2023

(65) Prior Publication Data

US 2024/0417156 A1 Dec. 19, 2024

(30) Foreign Application Priority Data

Oct. 8, 2021 (IT) ..... 102021000025784

(51) Int. Cl.
*B65D 85/10* (2006.01)

(52) U.S. Cl.
CPC ... *B65D 85/1048* (2020.05); *B65D 85/10564* (2020.05); *B65D 85/10568* (2020.05)

(58) Field of Classification Search
CPC ..... B65D 85/1048; B65D 85/10568; B65D 85/10564; B65D 50/06; B65D 85/12;
(Continued)

(56) References Cited

U.S. PATENT DOCUMENTS 4,948,038 A * 8/1990 Moeller ..... B65D 5/6611 229/149
5,366,077 A * 11/1994 Pham ..... B65D 85/10564 206/268
(Continued)

FOREIGN PATENT DOCUMENTS

DE 9114927 U1 4/1992
DE 102018127739 A1 5/2020
(Continued)

OTHER PUBLICATIONS

International Application No. PCT/IB2022/059490, International Search Report and Written Opinion, mailed Jan. 19, 2023.

*Primary Examiner* — Rafael A Ortiz
(74) *Attorney, Agent, or Firm* — MARSHALL, GERSTEIN & BORUN LLP

(57) ABSTRACT

A pack for smoking articles having: a group of smoking articles; a wrap housing the group of smoking articles; a rigid container, which is cup-shaped, houses the wrap and has: an open upper end, a lower wall, a front wall and rear wall, and two side walls; a lid, which is cup-shaped, is hinged to the container along a hinge so as to rotate, relative to the container, between an open position and a closed position, and has: an open lower end, an upper wall, a front wall and a rear wall, and two side walls; and a locking panel, which is at least partially glued to a first side wall of the container and has an upper edge, which is connected to a lower edge of a second side wall of the lid.

15 Claims, 16 Drawing Sheets

(58) Field of Classification Search
CPC ..... B65D 85/1045; B65D 85/1072; B65D 85/10566; A24F 15/00
USPC ..... 206/259, 264, 273, 268, 267, 242
See application file for complete search history.

(56) References Cited

U.S. PATENT DOCUMENTS

| | | | | | |
|---|---|---|---|---|---|
| 5,904,244 | A * | 5/1999 | Focke | ..... | B65D 85/10484 206/268 |
| 9,340,347 | B2 | 5/2016 | Holford | | |
| 2009/0288966 | A1 * | 11/2009 | Minarelli | ..... | B65D 5/6608 206/268 |
| 2018/0022538 | A1 * | 1/2018 | Li Vigni | ..... | B65D 81/2061 206/259 |

FOREIGN PATENT DOCUMENTS

| | | | | | |
|---|---|---|---|---|---|
| EP | 1724210 | A1 * | 11/2006 | ..... | B65D 5/6691 |
| WO | WO-03039998 | A1 * | 5/2003 | ..... | B65D 85/1045 |
| WO | WO-2014146957 | A1 * | 9/2014 | ..... | B65D 5/548 |
| WO | WO-2021152099 | A1 * | 8/2021 | ..... | B65D 5/549 |
| WO | WO-2022/029814 | A1 | 2/2022 | | |

* cited by examiner

RIGID PACK FOR SMOKING ARTICLES PROVIDED WITH A HINGED LID

CROSS-REFERENCE TO RELATED APPLICATIONS

This is a US national stage of International Application No. PCT/IB2022/059490, filed Oct. 5, 2022, which claims priority to Italian Patent Application No. 102021000025784 filed on Oct. 8, 2021, the entire disclosure of which is incorporated herein by reference.

TECHNICAL FIELD

The present invention relates to a rigid pack for smoking articles provided with a hinged lid.

The present invention finds advantageous application to a pack of cigarettes, to which the following description will make explicit reference without thereby losing generality.

PRIOR ART

Rigid packs of cigarettes with hinged lid are the most popular packs of cigarettes currently on the market as they are simple to produce, are easy and practical to use, and offer good protection for the cigarettes contained within the same.

A rigid pack of cigarettes with a hinged lid comprises a wrap made up of a group of cigarettes wrapped in a sheet of metallized paper and a rigid container that houses the wrap and is provided with a hinged lid; the wrap is initially completely closed and generally has an upper portion that can be removed by tearing (known as "pull") which is removed when the pack of cigarettes is first opened to allow the extraction of the cigarettes enclosed by the wrap.

A rigid pack of cigarettes with a hinged lid is generally provided with an overwrap that surrounds and encloses the outer container, it is made up of a sheet of transparent plastic material (typically cellophane or polypropylene), and is provided with a tear-off tape which is grasped and pulled by the user to divide (cut) the overwrap in two and therefore allows a simple and rapid removal, at least partial, of the overwrap. The overwrap also constitutes a guarantee of the integrity of the pack of cigarettes, namely, the presence of the overwrap guarantees that the pack of cigarettes has never been previously opened, since in order to open the pack of cigarettes it is necessary to break the overwrap in a way that cannot be reassembled. However, future environmental regulations may require to eliminate the overwrap to reduce the variety of wrapping materials used (namely, to eliminate the presence of polypropylene which is only used in the overwrap) and to reduce the amount of wrapping materials used. Namely, to increase environmental sustainability, initiatives to eliminate plastic materials in the packaging of cigarettes are growing significantly and one of the most widespread trends is to adopt a heat-sealed wrap made of paper having barrier properties and thus completely eliminating the plastic film of the overwrap.

To ensure the integrity of the pack of cigarettes, namely, to ensure that the pack of cigarettes has never been previously opened, a stamp (possibly also with tax value) can also be used, which is glued partly to the container and partly to the lid and is pre-weakened along a line, which overlaps the edge of the lid, so that, to open the lid for the first time, it is mandatory to tear (at least partially) the stamp. However, the stamp is generally little appreciated (when the presence thereof is not required by law if the stamp also has tax value) as it ruins (being an "irrelevant" addition) the aesthetic appearance (being an "irrelevant" addition) of the pack of cigarettes in an area particularly in evidence.

Among other things, it is important to ensure the integrity of the pack of cigarettes as, especially in poorer markets, an empty pack of cigarettes could be refilled with lower quality cigarettes (possibly provided with a new transparent overwrap in which the manufacturing thereof is relatively simple) and therefore sold as new in a counterfeited way.

Patent applications WO2021152099A1, DE102018127739A1, WO2014146957A1, EP1724210A1 and U.S. Pat. No. 9,340,347 describe rigid packs of cigarettes with hinged lid.

DESCRIPTION OF THE INVENTION

The purpose of the present invention is to provide a rigid pack for smoking articles provided with a hinged lid, which pack allows to highlight the completed first opening in a simple way even in the absence of a stamp and of an overwrap and, at the same time, is easy and inexpensive to implement.

According to the present invention, a rigid pack for smoking articles provided with a hinged lid, according to what is claimed in the attached claims is provided.

The claims describe preferred embodiments of the present invention forming an integral part of the present description.

BRIEF DESCRIPTION OF THE DRAWINGS

The present invention will now be described with reference to the attached drawings, which illustrate some non-limiting embodiments, in which.

PREFERRED EMBODIMENTS OF THE INVENTION

Figure 2:
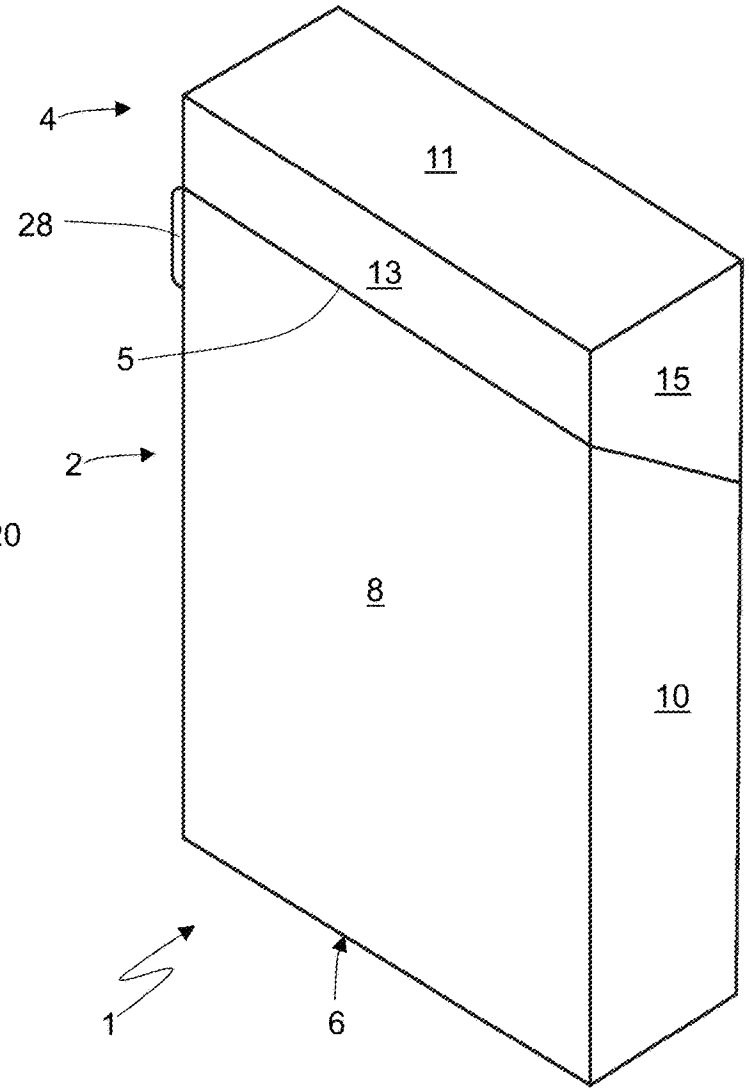
FIG. 2 is a rear perspective view and with the lid closed of the pack of cigarettes of FIG. 1.
Figure 1:
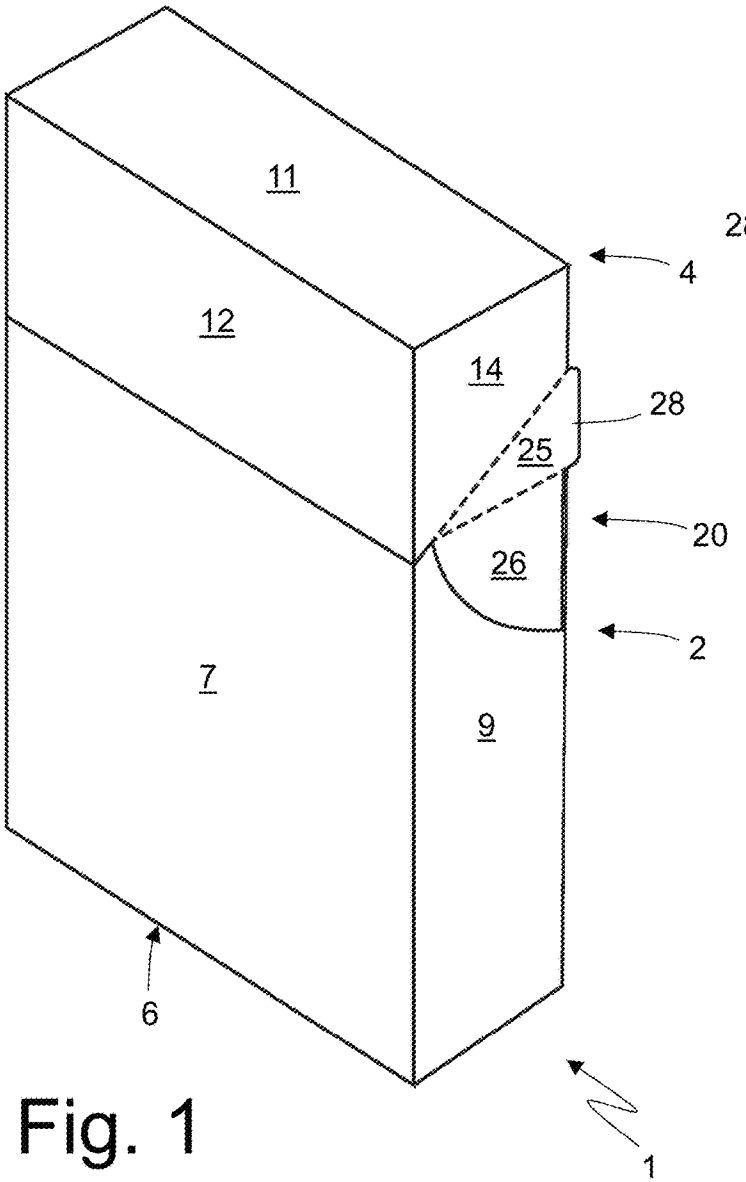
FIG. 1 is a front perspective view and with the lid closed of a pack of cigarettes made according to the present invention.
Figure 3:
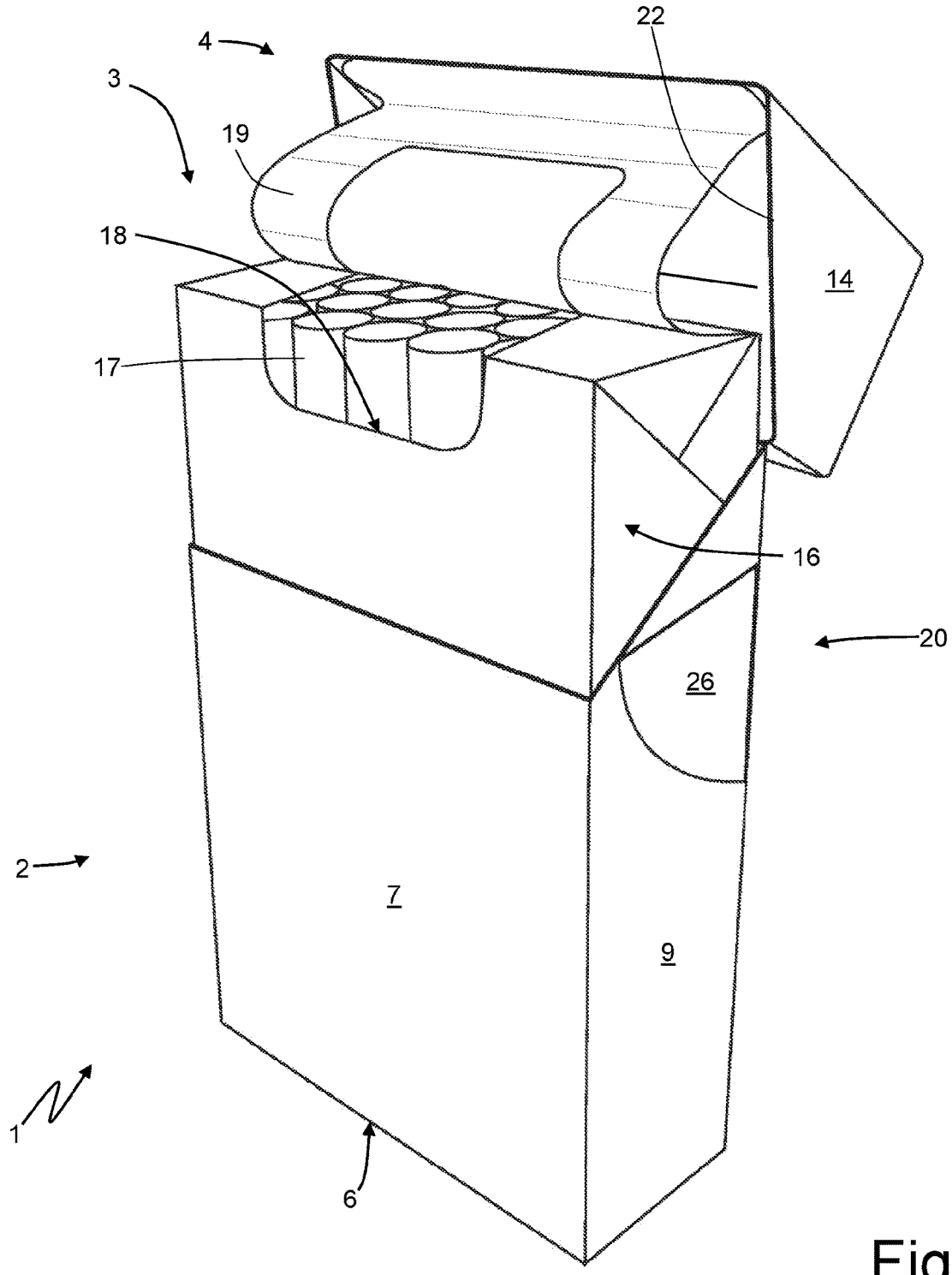
FIG. 3 is a front perspective view and with the lid open of the pack of cigarettes of FIG. 1.

In FIGS. 1, 2 and 3, number 1 denotes a rigid pack of cigarettes as a whole. The pack 1 of cigarettes comprises a container 2 which is preferably made of a paper material (cardboard or rigid paperboard), is cup-shaped and has a plurality of walls (better described in the following).

The container 2 has an open upper end 3 (illustrated in FIG. 3) and is provided with a lid 4, which is cup-shaped and is hinged to the container 2 along a hinge 5 (illustrated in FIG. 2) to rotate between a closing position (illustrated in FIGS. 1 and 2) and an opening position (illustrated in FIG. 3) of the open upper end 3. The container 2 has a substantially rectangular parallelepiped shape oriented according to a predominantly vertical development direction, is cup-shaped, and has the upper end 3 open, a lower wall 6 opposite the open upper end 3, a front wall 7 and a rear wall 8 (in which the hinge 5 is obtained) parallel and opposite to one another, and two side walls 9 and 10 parallel and opposite to one another. Four longitudinal edges are defined between the front 7, rear 8 and side 9 and 10 walls of the container 2, while four transverse edges are defined between the walls 7-10 and the lower wall 6 of the container 2.

The lid 4 has a substantially rectangular parallelepiped shape, is cup-shaped, and has an open lower end (facing the open upper end 3 of the container 2 when the lid 4 is in the closed position), an upper wall 11 (which is parallel and opposite the lower wall 6 of the container 2 when the lid 4 is in the closed position), a front wall 12 (which is parallel and aligned with the front wall 7 of the container 2 when the lid 4 is in the closed position), a rear wall 13 (which is parallel and aligned with the rear wall 8 of the container 2 when the lid 4 is in the closed position and is hinged to the rear wall 8 of the container 2 along the hinge 5), and two side walls 14 and 15 parallel and opposite to one another (which are parallel and aligned, in particular coplanar and adjacent, to the side walls 9 of the container 2 when the lid 4 is in the closed position). Four longitudinal edges are defined between the front 12, rear 13 and side 14 and 15 walls of the lid 4, while four transverse edges are defined between the walls 12-15 and the upper wall 11 of the lid 4. The longitudinal and transverse edges of the lid 4 are parallel and possibly aligned with the corresponding longitudinal and transverse edges of the container 2 when the lid 4 is in the closed position.

According to the embodiment illustrated in the attached figures, the pack 1 of cigarettes is devoid of a collar; according to a different embodiment not illustrated, the pack 1 of cigarettes comprises a collar, which is fixed (normally by gluing) folded in a "U" shape inside the container 2 to partially protrude outside the open upper end and engaging a corresponding inner surface of the lid 4 when the lid 4 is arranged in the aforementioned closed position; the collar is preferably provided with closing elements (for example a pair of projections protruding laterally) to keep the lid 4 in the closed position.

As illustrated in FIG. 3, the pack 1 of cigarettes comprises a sealed wrap 16 housed inside the container 2 to partially protrude outside the open upper end 3. The wrap 16 encloses a group 17 of cigarettes (partially illustrated in FIG. 3) having a parallelepiped shape and has at the top and in front an opening 18 for extracting cigarettes closed by a reusable closing label 19. Generally, the sealed wrap 16 comprises, on the inside thereof, a rigid reinforcement element that makes the presence of the collar unnecessary (redundant). According to an alternative embodiment not illustrated, the wrap 16 is not sealed, is made up by a sheet of metallized paper (the so-called "tinfoil") folded around the group 17 of cigarettes and devoid of glue, and has an upper portion that can be removed by tearing (known as "pull") which is removed at the first opening of the pack 1 of cigarettes; in this embodiment the collar is normally provided.

Figure 4:
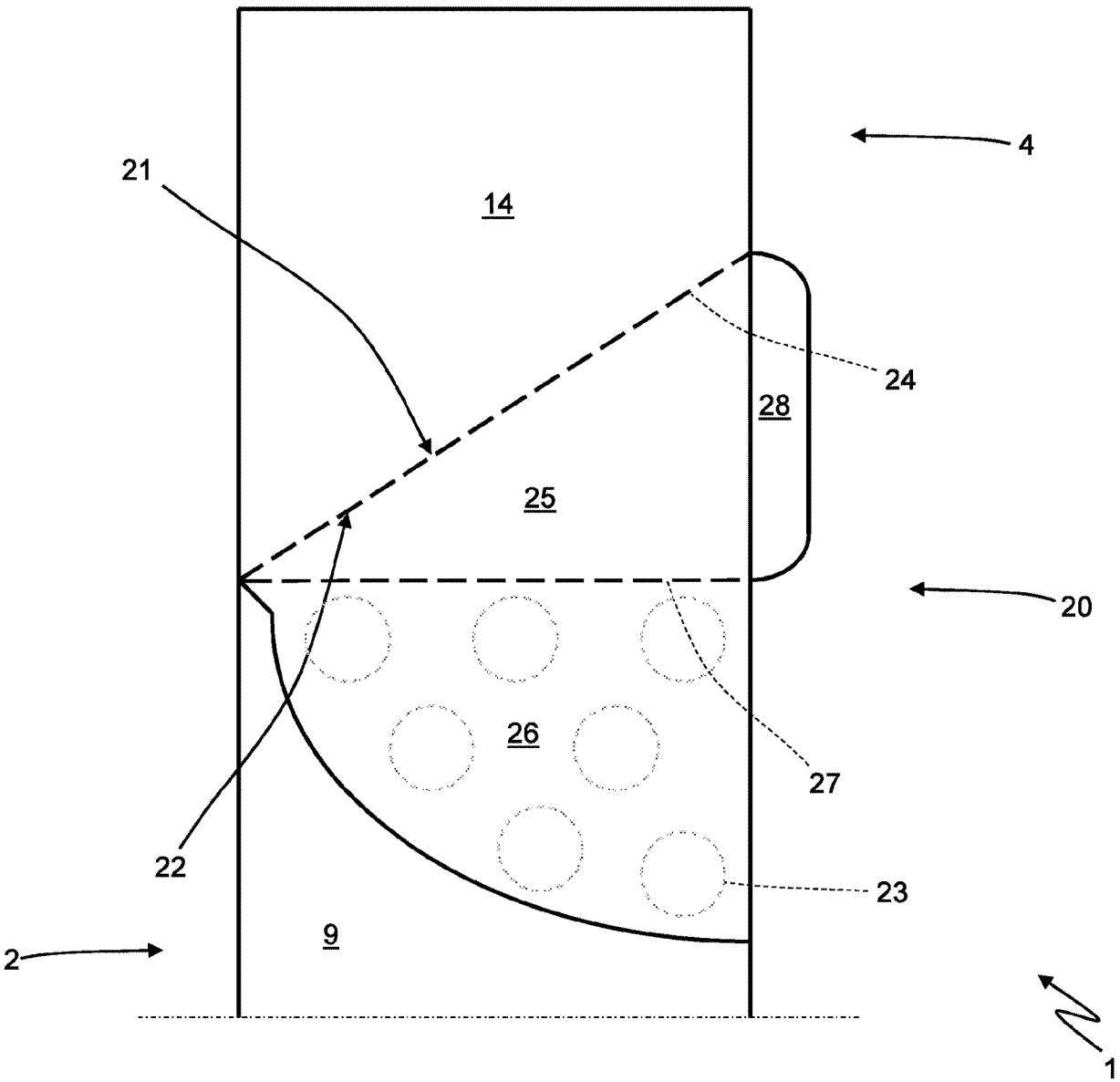
FIG. 4 is a side view and with the lid closed of the pack of cigarettes of FIG. 1.

According to what is better illustrated in FIG. 4, the pack 1 of cigarettes comprises a locking panel 20, which is at least partially glued to the side wall 9 of the container 2 and has an upper edge 21 which is connected to a lower edge 22 of the side wall 14 of the lid 4. Namely, an inner surface (that is, facing the side wall 9 of the container 2) of the locking panel 20 is at least partially glued to the side wall 9 of the container 2 by interposing a glue 23. The locking panel 20 binds the side wall 14 of the lid 4 to the side wall 9 of the container 2 (namely, it establishes a rigid connection between the side wall 14 of the lid 4 and the side wall 9 of the container 2) and thus prevents the lid 4 from opening by rotating around the hinge 5.

According to a preferred embodiment illustrated in the attached figures, the upper edge 21 of the locking panel 20 is connected to the lower edge 22 of the side wall 14 by means of a pre-weakened and tearable connection line 24 which, in use, is torn to separate the locking panel 20 from the side wall 14 of the lid 4 and then "free" the lid 4 (namely, allowing the lid 4 to open by rotating around the hinge 5).

According to a possible embodiment, the glue 23 is weak and detachable and therefore in use the locking panel 20 can be easily and completely detached from the side wall 9 of the container 2 so as to "free" the lid 4 (namely, to allow the lid 4 to open by rotating around the hinge 5); in this embodiment it is not (strictly) necessary to "break" the locking panel 20 since it is possible to completely detach the locking panel 20 from the side wall 9 of the container 2. In other words, the locking panel 20 is glued to the side wall 9 of the container 2 by means of the weak and detachable glue 23 which, in use, allows the locking panel 20 to be completely separated from the side wall 9 of the container 2.

Figure 5:
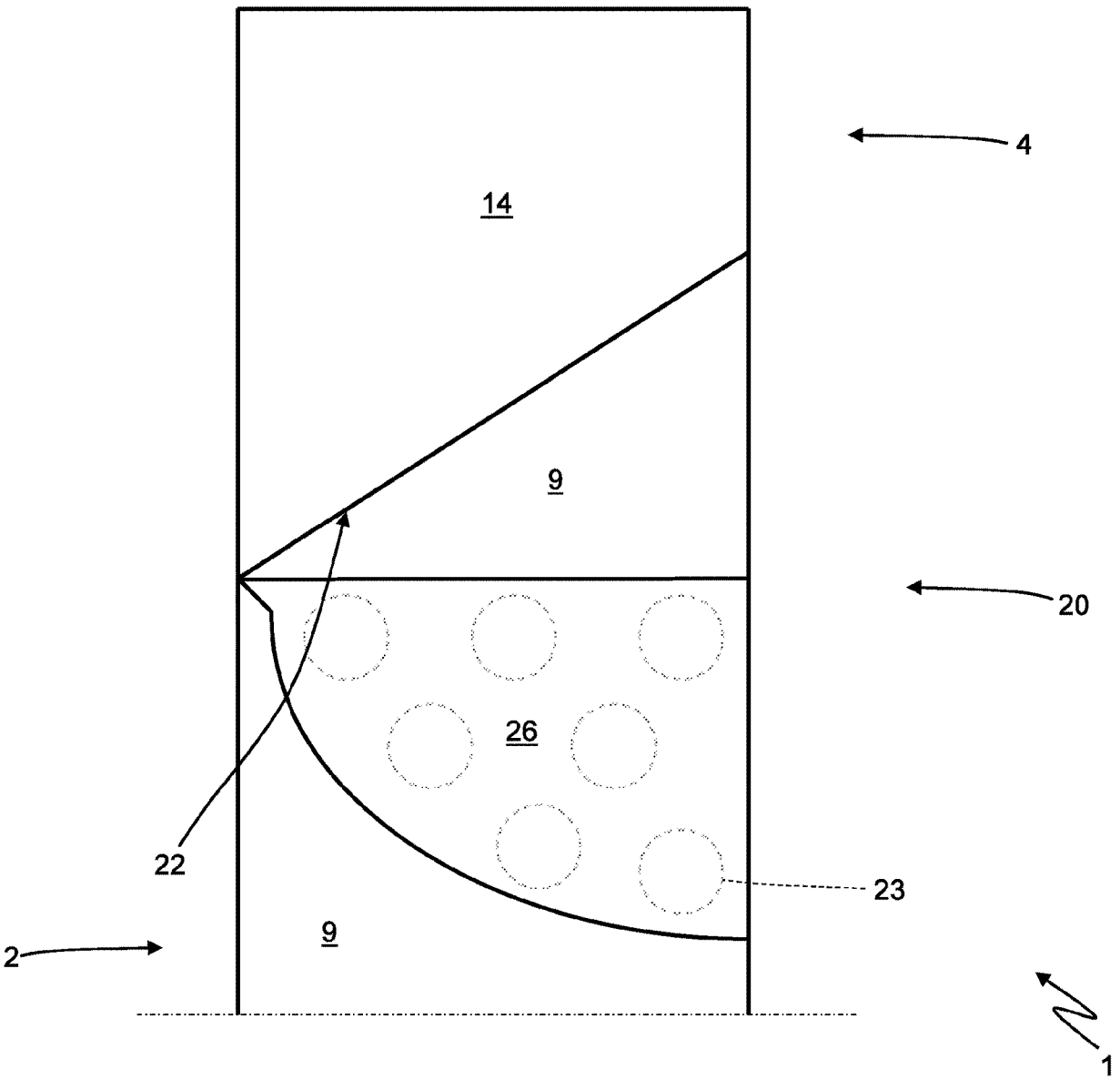
FIG. 5 is a side view, with the lid closed, and devoid of a removable part of a locking panel of the pack of cigarettes of FIG. 1.

According to a preferred embodiment illustrated in the attached figures, the glue 23 is strong and inseparable and therefore in use the locking panel 20 cannot in any way be completely detached (except by tearing everything by force and therefore destroying part of the side wall 9 of the container 2) from the side wall 9 of the container 2 so as to "free" the lid 4 (namely, to allow the lid 4 to open by rotating around the hinge 5). In other words, the locking panel 20 is glued to the side wall 9 of the container 2 by means of the strong and inseparable glue 23 which, in use, does not allow the locking panel 20 to be separated from the side wall 9 of the container 2. In this embodiment, the locking panel 20 comprises an upper removable portion 25 (namely, arranged closer to the upper wall 11 of the lid 4) which has the upper edge 21 connected to the lower edge 22 of the side wall 14 of the lid 4 and is not glued to the side wall 9; moreover, the locking panel 20 comprises a lower anchoring portion 26 (namely, arranged farther away from the upper wall 11 of the lid 4) which is glued to the side wall 9 of the container 2. In other words, the locking panel 20 is made up of the removable portion 25 integral with the side wall 14 of the lid 4 and by the anchoring portion 26 glued to the side wall 9 of the container 2. In use, the removable portion 25 of the locking panel 20 is removed by tearing to "free" the lid 4 (namely, to allow the lid 4 to open by rotating around the hinge 5); in this regard, compare what is illustrated in FIG. 4 (in which the removable portion 25 of the locking panel 20 is still provided and therefore it is not possible to open the lid 4) with what is illustrated in FIG. 5 (in which the removable portion 25 of the locking panel 20 is no longer provided and therefore it is possible to open the lid 4).

According to a preferred embodiment illustrated in the attached figures, the locking panel 20 has a pre-weakened and tearable connection line 27 which divides the removable portion 25 from the anchoring portion 26; in use, it is therefore possible to completely remove the removable portion 25 by performing a double tear both along the pre-weakened connection line 24 (which connects the removable portion 25 at the top to the side wall 14 of the lid 4), and along the pre-weakened connection line 27 (which connects the removable portion 25 at the bottom to the anchoring portion 26 and therefore to the side wall 9 of the container 2). Preferably, the pre-weakened and tearable connection line 27 forms an acute angle with the pre-weakened and tearable connection line 24 and originates from the pre-weakened and tearable connection line 24.

According to a possible embodiment, the side wall 9 of the container 2 is printed with a particular colour/design in correspondence with the area initially covered by the removable portion 25 of the locking panel 20 so that the particular colour/design becomes visible once that the removable portion 25 has been removed (namely, after the first opening of the lid 4).

According to a preferred embodiment illustrated in the attached figures, the locking panel 20 has a holding tab 28 which projects from the rear wall 8 of the container 2; in use, the user can easily grasp the holding tab 28 with the fingers to pull on the holding tab 28 and then simply and quickly remove the removable portion 25 of the locking panel 20 by making a tear along both pre-weakened and tearable connection lines 24 and 27.

According to a preferred embodiment, each pre-weakened and tearable connection line 24 or 27 is made up of an alternation of through cuts and whole portions; in particular, the through cuts extend along 40-60% of a total length of the pre-weakened and tearable connection line 24 or 27. In other words, each pre-weakened and tearable connection line 24 or 27 could comprise two, three or four joining portions (namely, whole portions) each having a length of 0.6-0.8 mm.

According to a different embodiment not illustrated, the upper edge 21 of the locking panel 20 is permanently and inseparably connected to the lower edge 22 of the side wall 14 of the lid 4 (namely, there is no pre-weakened and tearable connection line 24, which is replaced by a permanent and non-separable connection line); in this embodiment, at least part of the locking panel 20 is always integral with the side wall 14 of the lid 4 and therefore when the lid 4 opens at least part of the locking panel 20 moves together with the lid 4. In this embodiment, the whole locking panel 20 can move together with the lid 4 or only an upper portion (corresponding to the removable portion 25 described above that in this embodiment is no longer removed) of the locking panel 20 moves together with the lid 4 while a lower portion (corresponding to the anchoring portion 26 described above) of the locking panel 20 remains integral with the side wall 9 of the container 2 (therefore the pre-weakened and tearable connection line 27 is still provided, which allows to divide in two the locking panel 20). In other words, in this embodiment: the upper edge 21 of the locking panel 20 is permanently and inseparably connected to the lower edge 22 of the side wall 14, the locking panel 20 comprises an upper connection portion (corresponding to the removable portion 25 described above that in this embodiment is no longer removed), which has the upper edge 21 connected to the lower edge 22 of the side wall 14 and is not glued to the side wall 9, the locking panel 20 comprises a lower anchoring portion 26 that is glued to the side wall 9, and the locking panel 20 has a pre-weakened and tearable connection line 27 that divides the connection portion (corresponding to the previously described removable portion 25 that in this embodiment is no longer removed) from the anchoring portion 26.

Figure 6:
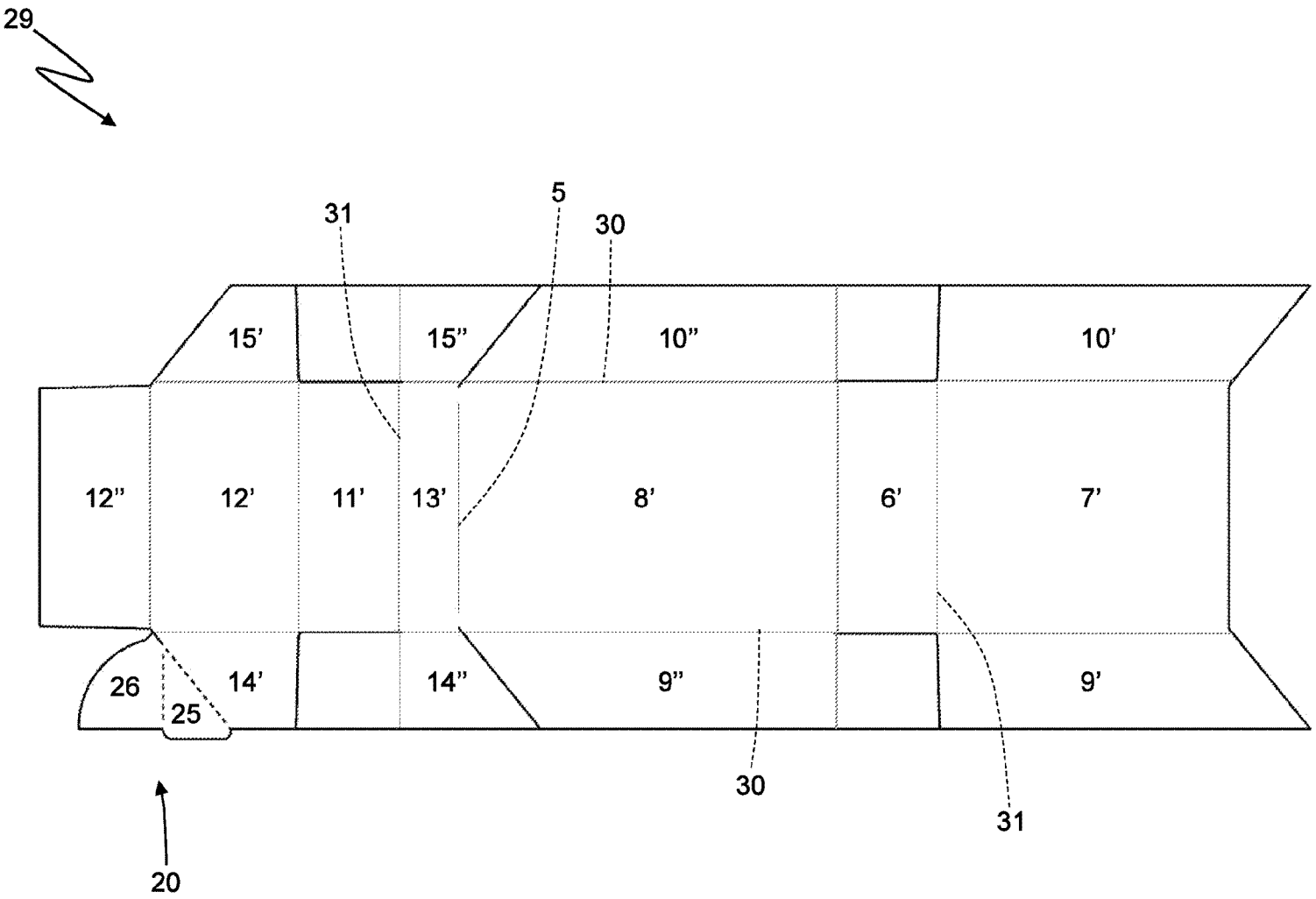
FIG. 6 is a plan view of a blank used to make a container and a hinged lid for the pack of cigarettes of FIG. 1.

As illustrated in FIG. 6, the container 2 and the lid 4 are made by folding a rigid blank 29 of a substantially conventional type and provided with a plurality of pre-weakened folding lines 30 and 31. The blank 29 comprises two longitudinal (pre-weakened) folding lines 30 and a plurality of transversal (pre-weakened) folding lines 31 which define, between the two longitudinal folding lines 30, a panel 7' forming the front wall 7 of the container 2, a panel 6' forming the lower wall 6 of the container 2, a panel 8' forming the rear wall 8 of the container 2, a panel 13' forming the rear wall 13 of the lid 4, a panel 11' forming the upper wall 11 of the lid 4, a panel 12' forming the front wall 12 of the lid 4, and a reinforcement flap 12".

The reinforcement flap 12" is connected to the front wall 12 of the lid 4 along a transversal folding line 31, it is folded by 180° (in the pack 1 of cigarettes) with respect to the front wall 12 of the lid 4 (namely, with respect to the panel 12'), and rests on and is glued against an inner surface of the front wall 12 of the lid 4 (namely, against the panel 12').

The blank 29 comprises a pair of fins 9' and 10', which are arranged on opposite sides of the panel 7', are connected to the panel 7' along the two longitudinal folding lines 30, and form an (outer) part of the walls 9 and 10 on the sides of the container 2. The blank 29 comprises a pair of fins 9" and 10", which are arranged on opposite sides of the panel 8', are connected to the panel 8' along the two longitudinal folding lines 30, forming an (inner) part of the side walls 9 and 10 of the container 2, and overlap and are glued to the corresponding fins 9' and 10' to form the side walls 9 and 10 of the container 2. In other words, the side wall 9 of the container 2 comprises an inner panel 9" and an outer panel 9', which overlap and are glued to one another; similarly, the side wall 10 of the container 2 comprises an inner panel 10" and an outer panel 10", which overlap and are glued to one another.

The blank 29 comprises a pair of fins 14' and 15', which are arranged on opposite sides of the panel 12', are connected to the panel 12' along the two longitudinal folding lines 30, and form an (outer) part of the side walls 14 of the lid 4. The blank 29 comprises a pair of flaps 14" and 15", which are arranged on opposite sides of the panel 13', are connected to the panel 13' along the two longitudinal folding lines 30, forming an (inner) part of the side walls 14 and 15 of the lid 4, overlap and are glued to the corresponding fins 14' and 15' to form the side walls 14 and 15 of the lid 4.

The locking panel 20 is connected to the panel 14' (which forms an outer part of the side wall 14 of the lid 4) along the pre-weakened and tearable connection line 24.

Figure 7:
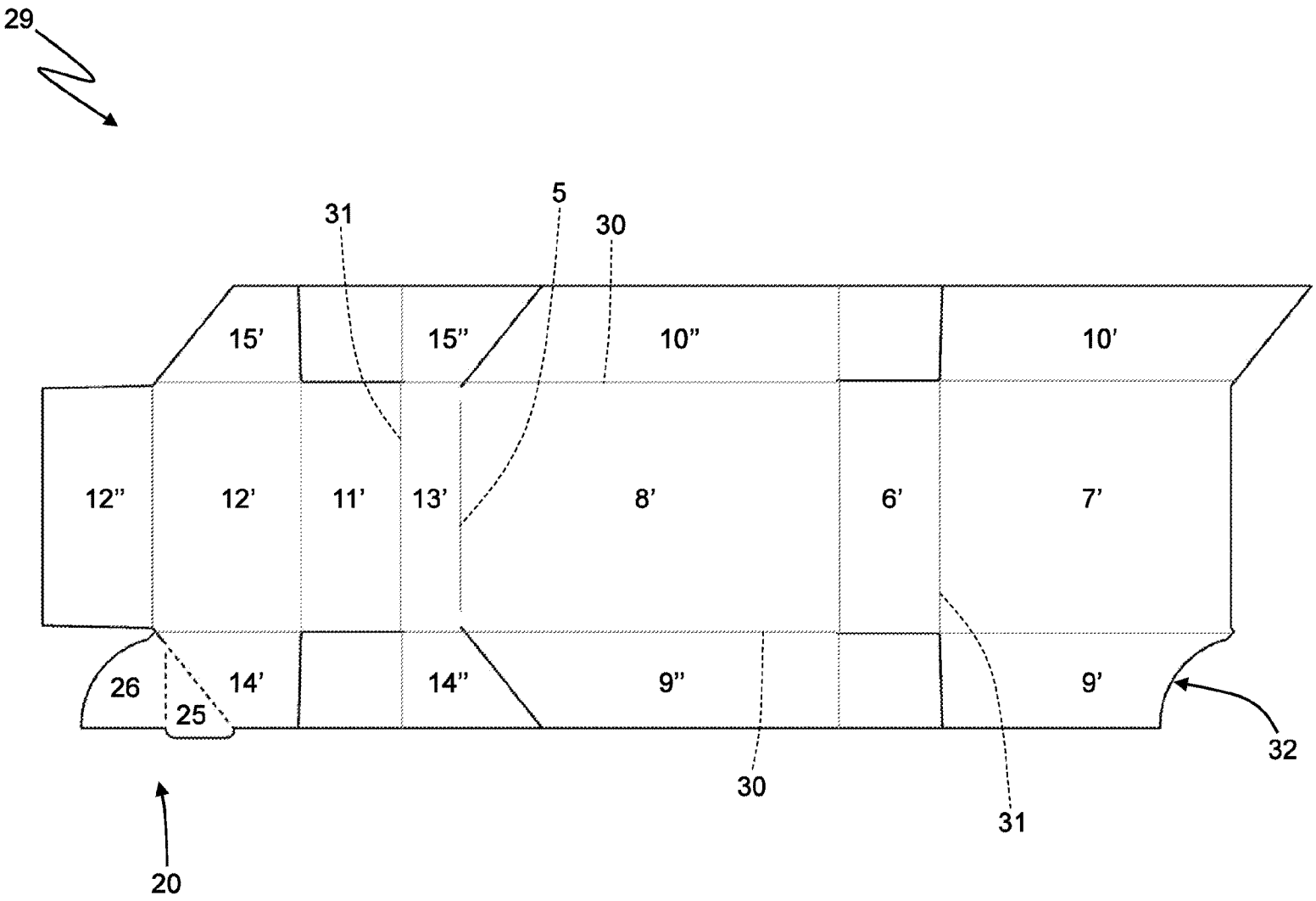
FIGS. 7-17 are respective views of alternative embodiments of the blank illustrated in FIG. 6.
Figure 8:
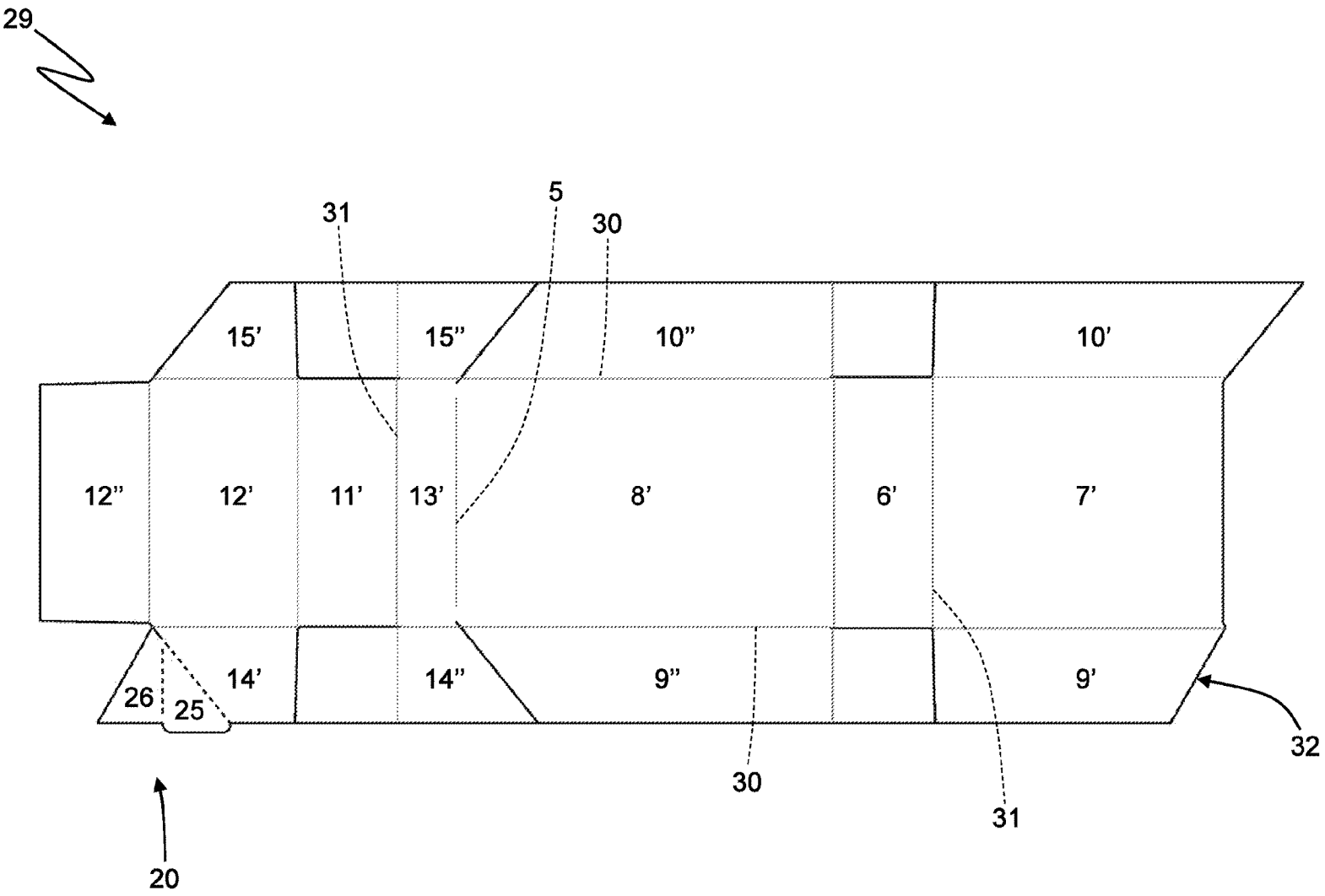
Figure 9:
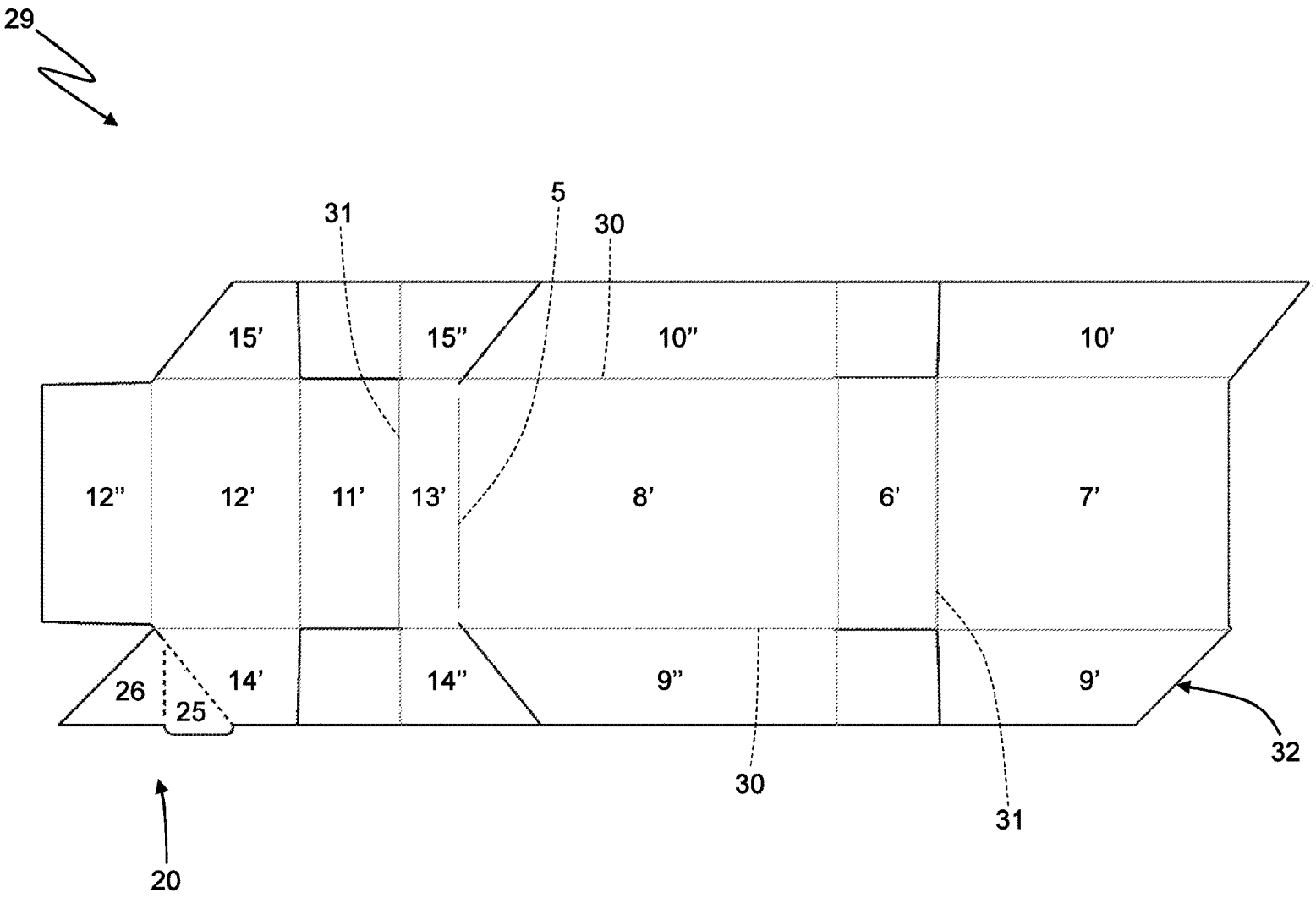
Figure 10:
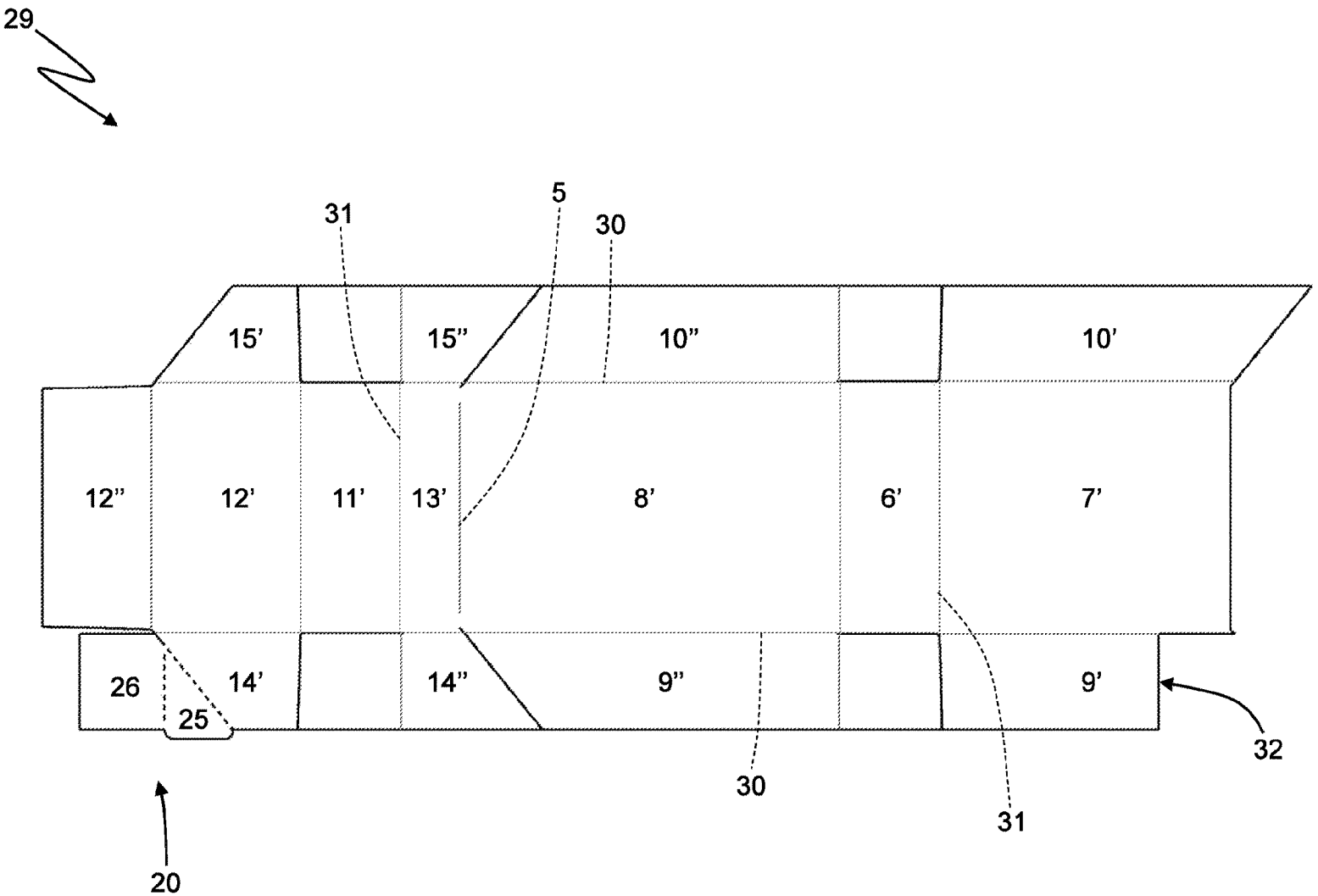
Figure 11:
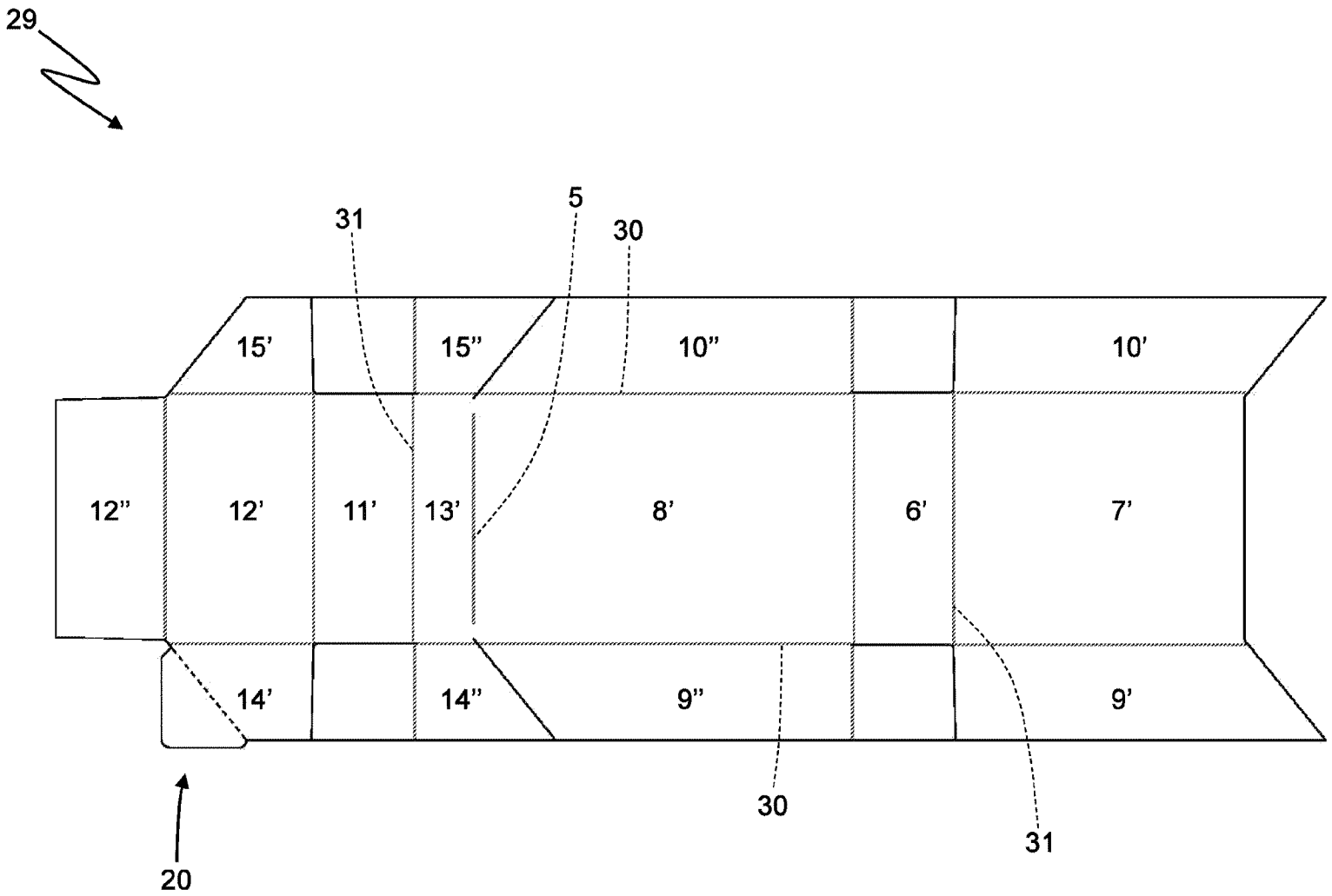
Figure 12:
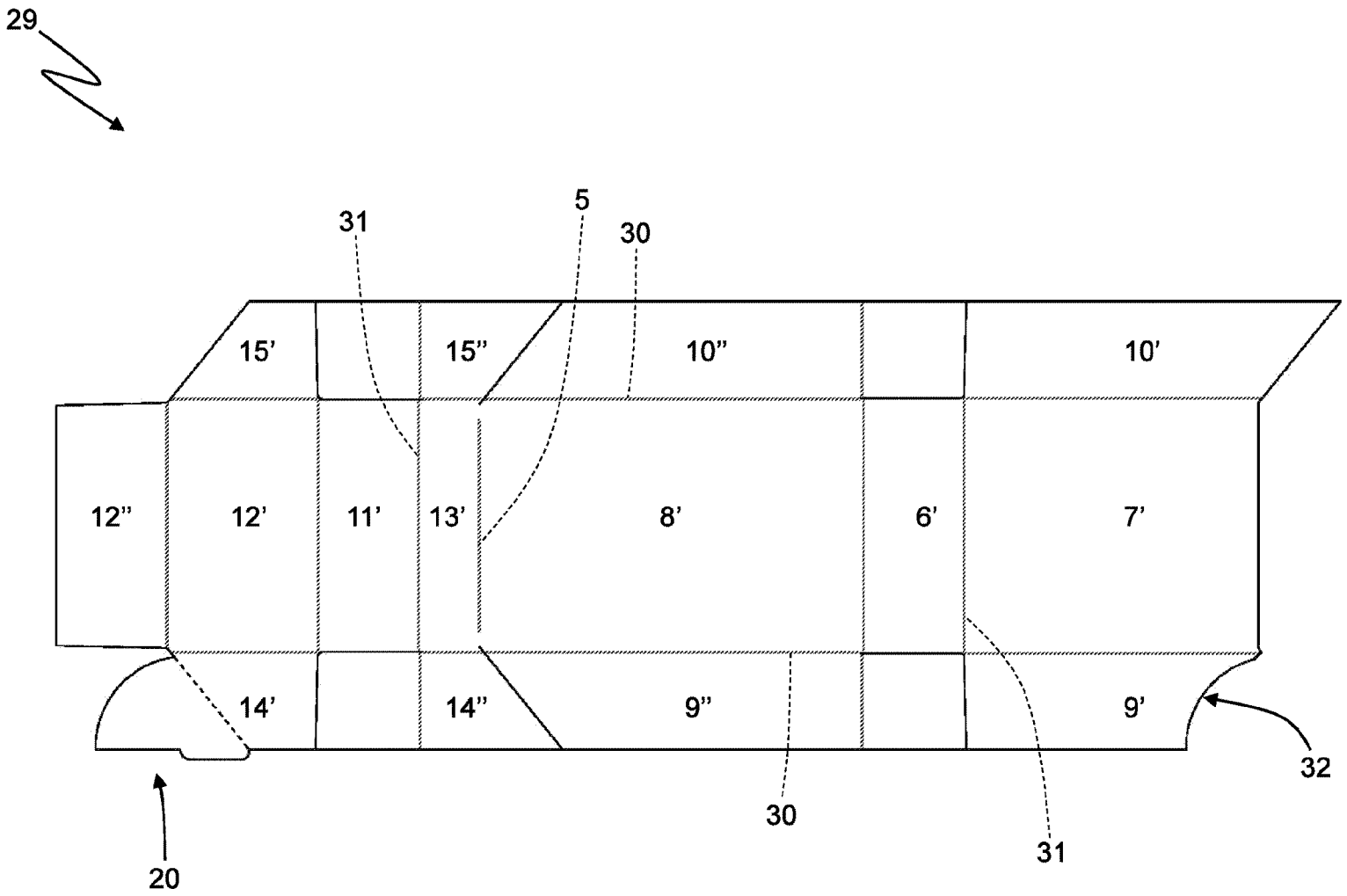
Figure 13:
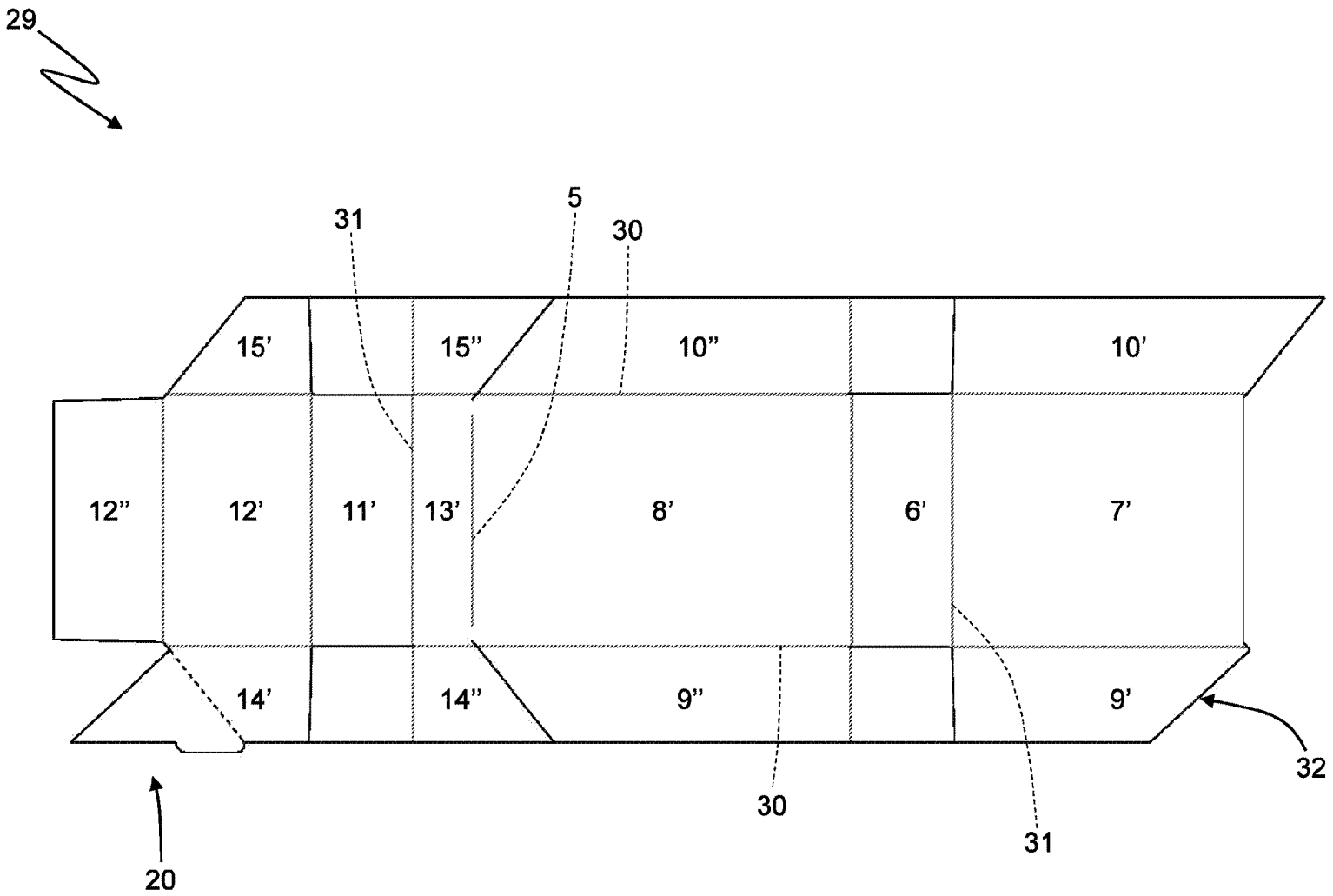
Figure 14:
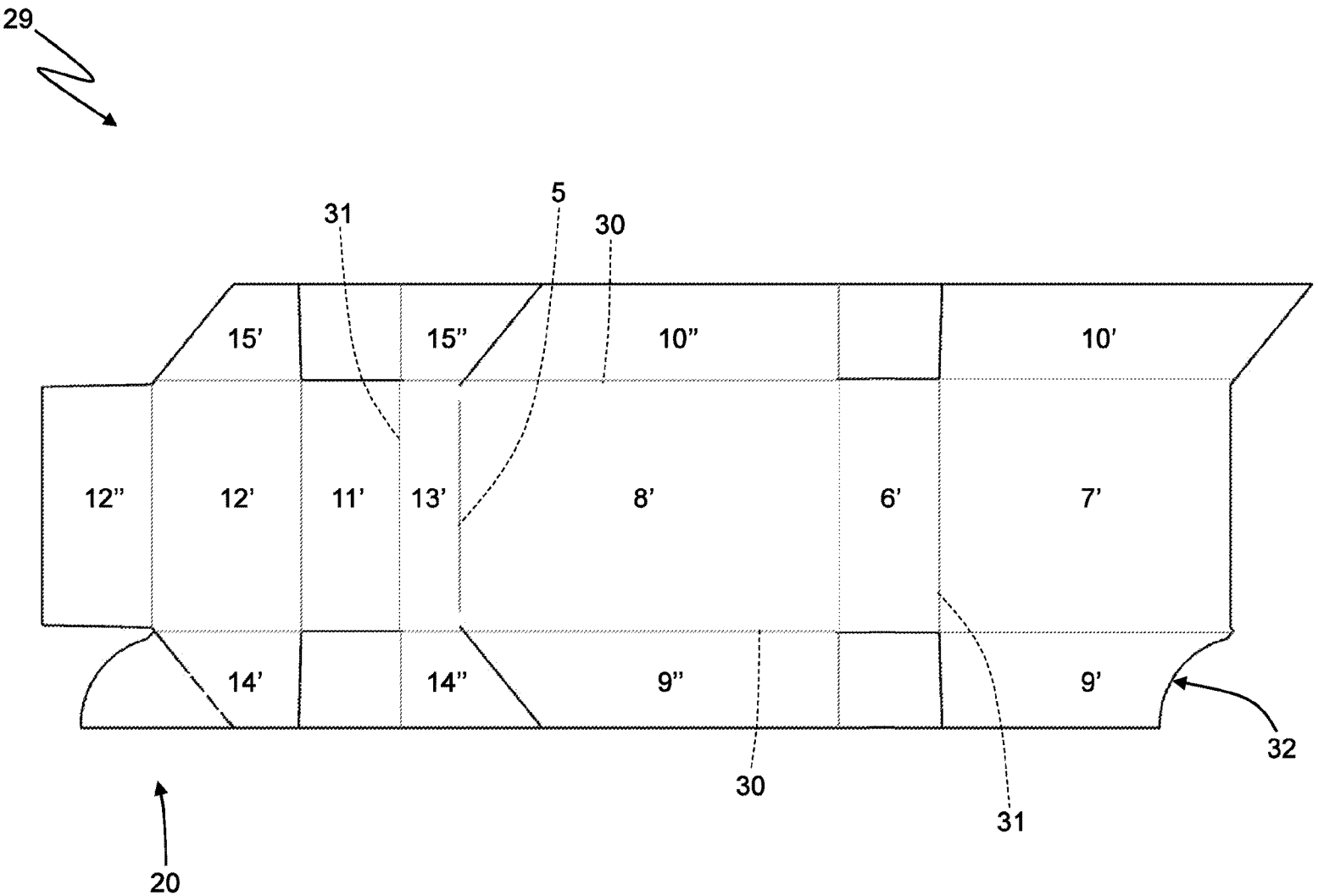

In the embodiment illustrated in FIGS. 1-6, the locking panel 20 (in particular the removable portion 25 of the locking panel 20) is connected (glued) to the outer panel 9' of the side wall 9 of the container 2. FIGS. 7-10 illustrate four alternatives of the blank 29 to which correspond as many alternatives of the pack 1 of cigarettes; in particular, in the four alternatives illustrated in FIGS. 7-10, the outer panel 9' of the side wall 9 of the container 2 has a recess 32 that reproduces in negative the shape of the locking panel 20 (in particular of the anchoring portion 26 of the locking panel 20) and inside which the locking panel 20 is arranged (in particular the anchoring portion 26 of the locking panel 20) so that the locking panel 20 is coplanar with the outer panel 9'; in this embodiment, the locking panel 20 (in particular the anchoring portion 26 of the locking panel 20) is glued to the inner panel 9" of the side wall 9 of the container 2. The alternatives of the blank 29 illustrated in FIGS. 8-10 differ from what is illustrated in FIG. 7 due to the different shape of the locking panel 20 (in particular of the anchoring portion 26 of the locking panel 20) and consequently to the different shape of the recess 32 which must reproduce in negative the shape of the locking panel 20 (in particular of the anchoring portion 26 of the locking panel 20). The presence of the recess 32 (namely, the particular shaping of the blank 29 that creates the recess 32) also has another positive effect, since, due to the recess 32, the blank 29 can be cut from a continuous strip of wrapping material without generating waste of wrapping material (except for a small amount due to the presence of the holding tab 28).

In the alternatives illustrated in FIGS. 11-14, the locking panel 20 is completely removed by tearing at the first opening of the pack 1 of cigarettes (namely, it is no longer divided into a removable portion 25 and an anchoring portion 26 but is completely eliminated by tearing at the first opening of the pack 1 of cigarettes). In the alternative illustrated in FIG. 11 no recess 32 is provided and the locking panel 20 has a smaller dimension, while in the alternatives illustrated in FIGS. 12-14 the recess 32 is provided and the locking panel 20 has a larger dimension.

In the embodiments illustrated in the attached figures, the pack 1 of cigarettes comprises one single locking panel 20 arranged on one side; according to alternative embodiments not illustrated, the pack 1 of cigarettes comprises two twin (and redundant) locking panels 20 arranged on two opposite sides.

Figure 15:
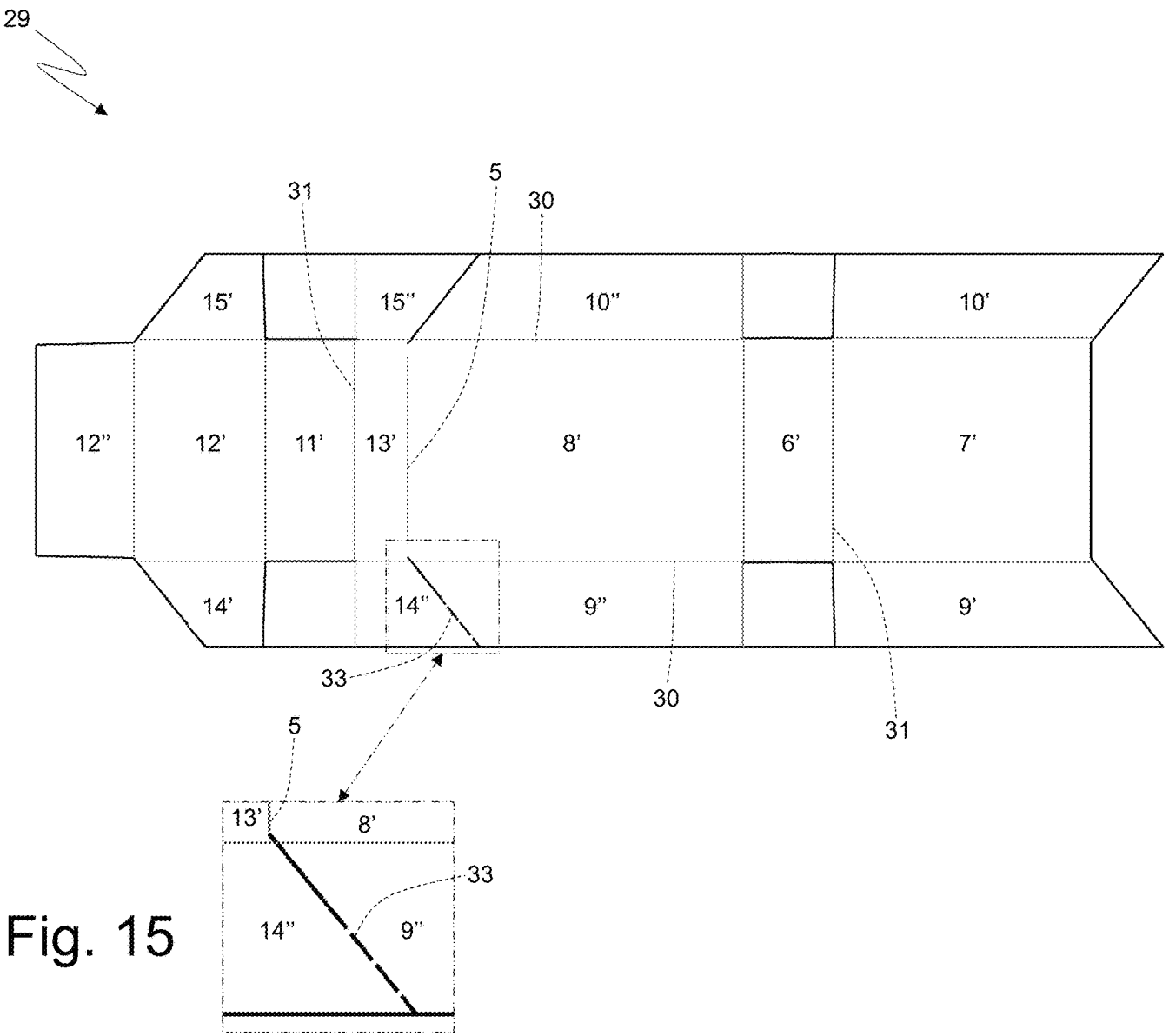

FIG. 15 illustrates a blank 29 for producing a completely different pack 1 of cigarettes which is devoid of the locking panel 20; in this pack 1 of cigarettes a pre-weakened and tearable connection line 33 is provided, which directly joins the side wall 14 of the lid 4 (in particular the inner panel 14" of the side wall 14) to the side wall 9 of the container 2 (in detail to the inner panel 9" of the side wall 9). In order to open the lid 4 it is necessary to tear off the pre-weakened connection line 33, which binds the side wall 14 of the lid 4 to the side wall 9 of the container 2. According to a different embodiment not illustrated, two pre-weakened and tearable connection lines 33 could be provided: a pre-weakened and tearable connection line 33 connects the side wall 14 of the lid 4 (in particular the inner panel 14" of the side wall 14) to the side wall 9 of the container 2 (in particular to the inner panel 9" of the side wall 9) while the other pre-weakened and tearable connection line 33 connects the side wall 15 of the lid 4 (in particular the inner panel 15" of the side wall 15) to the side wall 10 of the container 2 (in particular to the inner panel 10" of the side wall 10). Preferably, the pre-weakened and tearable connection line 33 has a greater number (length) of whole portions in an area close to the hinge 5 and has a smaller number (length) of whole portions in an area away from the hinge 5.

Figure 16:
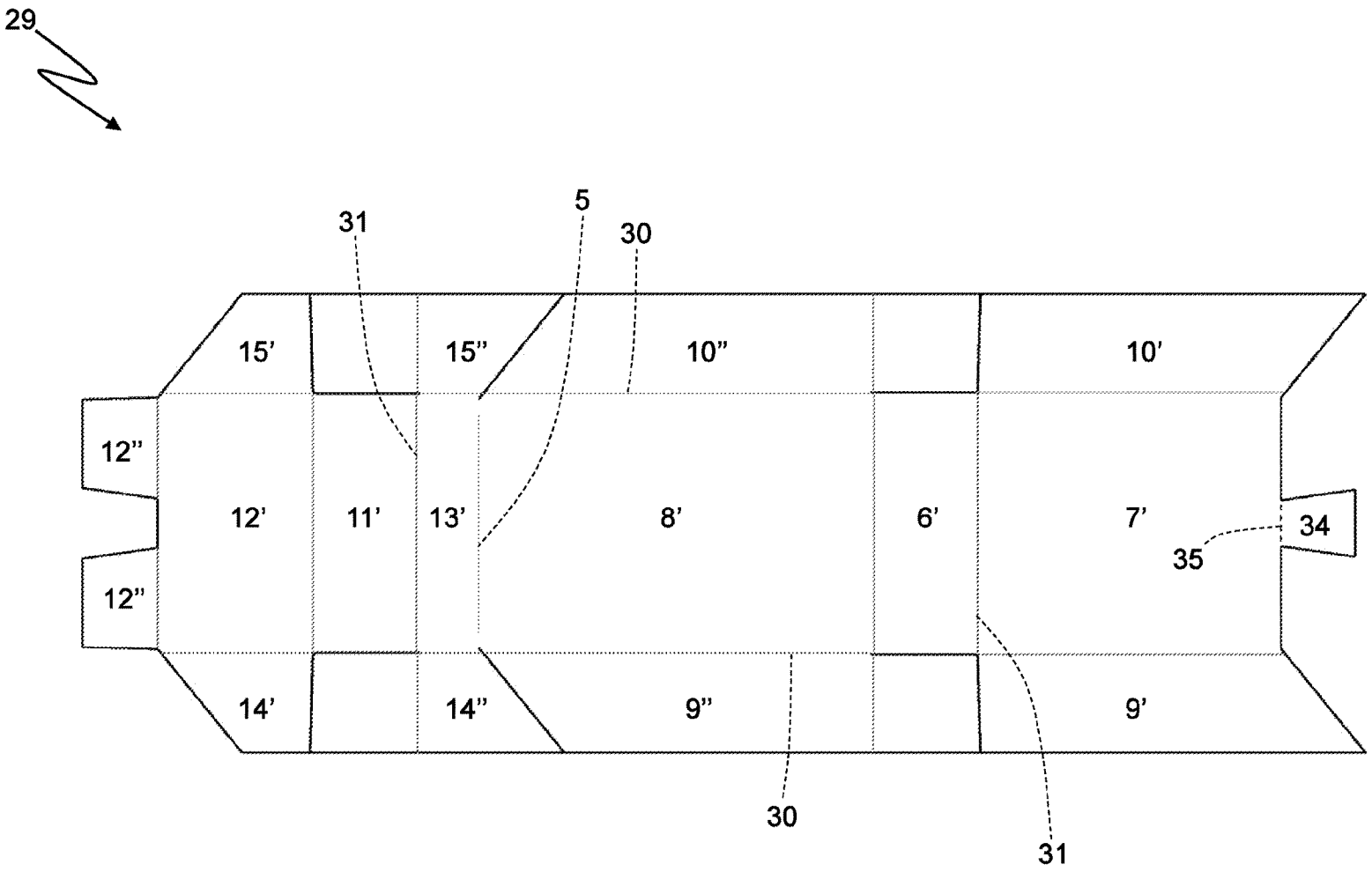
Figure 17:
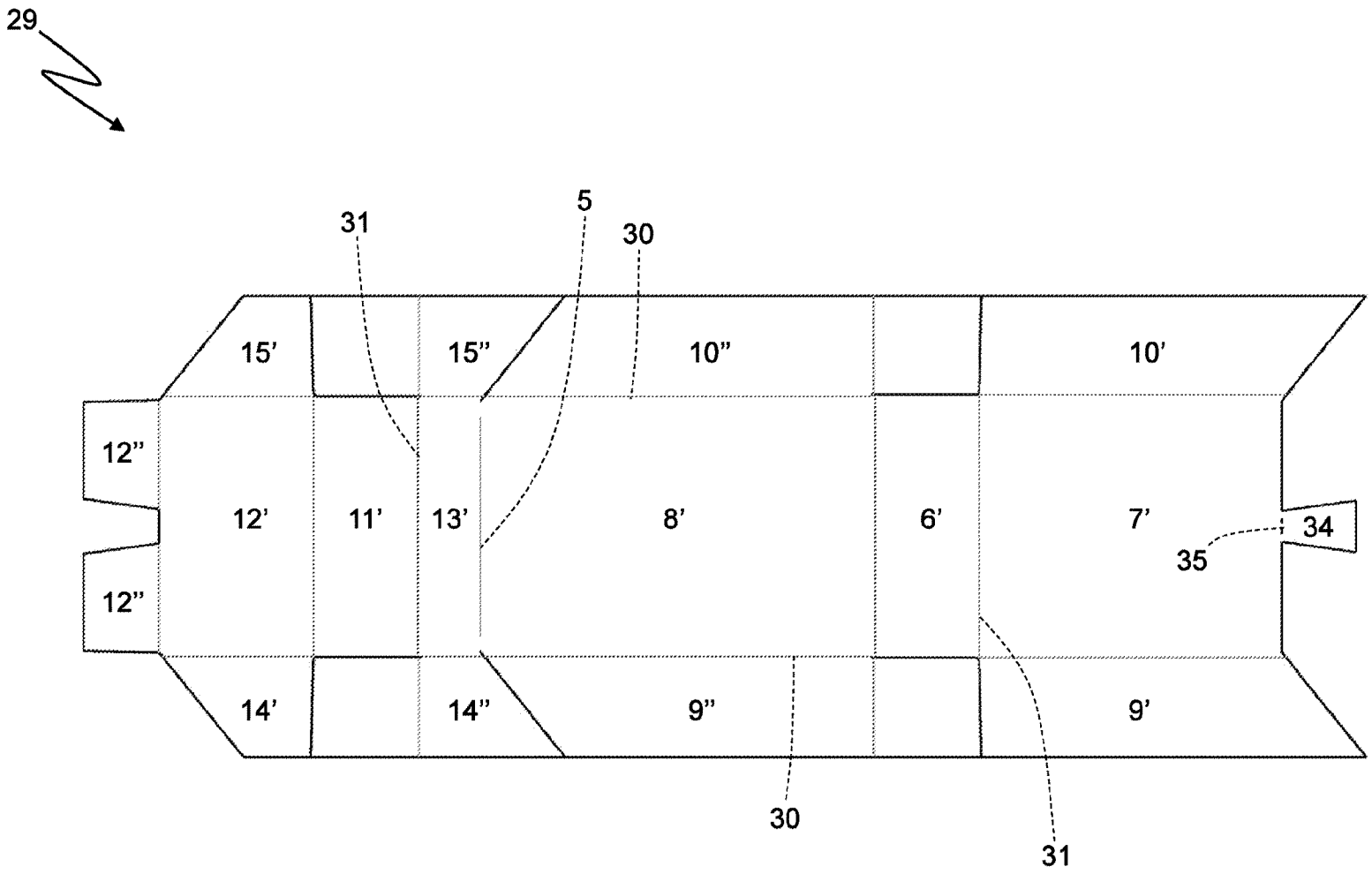

FIGS. 16 and 17 illustrates blanks 26 for making a completely different pack 1 of cigarettes which is devoid of the locking panel 20; in this pack 1 of cigarettes a locking panel 34 is provided which connects an upper edge of the front wall 7 of the container 2 to the front wall 12 of the lid 4 (in particular to an inner surface of the front wall 12 of the lid 4); in particular, the locking panel 24 is connected to the upper edge of the front wall 7 of the container 2 along a pre-weakened and tearable connection line 35 (which is torn off at the first opening of the lid 4) and is glued to the front wall 12 of the lid 4. The alternatives illustrated in FIGS. 16 and 17 differ from one another only in the dimension of the locking panel 34 (somewhat larger in the embodiment illustrated in FIG. 16 and somewhat smaller in the embodiment illustrated in FIG. 17). Preferably, one single locking panel 34 is provided in the centre and has an isosceles trapezoidal shape in which the smaller base is arranged in the area of the upper edge of the front wall 7 of the container 2 (namely, at the pre-weakened and tearable connection line 35).

In the embodiments illustrated in the attached figures, the longitudinal and transverse edges are straight; alternatively, the longitudinal and/or transverse edges could be rounded or bevelled.

In the embodiments illustrated in the attached figures, the pack 1 of cigarettes contains a group of cigarettes; alternatively, the pack 1 of cigarettes can contain any other type of smoking articles such as for example cigars, electric or electronic cigarettes (namely, cigarettes that generate an aerosol without combustion), cartridges and refills for electronic cigarettes, new generation cigarettes.

The embodiments described herein can be combined with one another without departing from the scope of the present invention.

The pack 1 of cigarettes described above has numerous advantages.

First, the pack 1 of cigarettes described above allows the highlighting of the first opening of the lid in a simple way even in the absence of a stamp; in fact, when a user has to tear off the locking panel 20 (or only part of the locking panel 20, in particular the removable portion 25 of the locking panel 20) an operation is performed that cannot be cancelled or masked (tearing at least part of the locking panel 20 is a definitive and non-recomposable break that can be made only once), which leaves an indelible mark of the completed first opening of the pack 1 of cigarettes.

Furthermore, in the pack 1 of cigarettes described above the presence of the locking panel 20 also ensures a stable and relatively strong connection between the lid 4 and the container 2 which always keeps the lid 4 in the closed position (until the user decides to open the lid 4 for the first time); in this way it is also prevented that the lid 4 can open accidentally (namely, in a completely random and undesirable way) during the handling of the pack 1 of cigarettes.

Finally, the pack 1 of cigarettes described above can be made in a standard packing machine for rigid packs of cigarettes with hinged lid with very few modifications concentrating essentially in the laying of the glue 23 (the locking panel 20, possibly provided with weakening lines 24 and/or 27, obtained at the time of production of the blank 29 as a simple integration of the normal cutting and printing operations). Therefore, the pack 1 of cigarettes described above for its production does not require the use of an expensive special packing machine (that is, specially designed for this type of pack 1 of cigarettes).

LIST OF REFERENCE NUMBERS OF THE FIGURES

1 pack of cigarettes
2 container
3 open upper end
4 lid
5 hinge
6 lower wall
7 front wall
8 rear wall
9 side wall
10 side wall
11 upper wall
12 front wall
13 rear wall
14 side wall
15 side wall
16 wrap
17 group of cigarettes
18 extraction opening
19 closing label
20 locking panel
21 upper edge
22 lower edge

23 glue
24 pre-weakened connection line
25 removable portion
26 anchoring portion
27 pre-weakened connection line
28 holding tab
29 blank
30 longitudinal folding lines
31 transverse folding lines
32 recess
33 pre-weakened connection line
34 locking panel
35 pre-weakened connection line

The invention claimed is:

1. A pack (1) for smoking articles comprising:

a group (17) of smoking articles;

a wrap (16), which houses the group (17) of smoking articles;

a rigid container (20, which is cup-shaped, houses the wrap (16) and has: an open upper end (3), a lower wall (6) opposite the open upper end (3), a front wall (7) and a rear wall (8) opposite one another, and two side walls (9, 10) opposite one another;

a lid (4), which is cup-shaped, is hinged to the container (2) along a hinge (5) so as to rotate, relative to the container (2), between an open position and a closed position and has: an open lower end, an upper wall (11), a front wall (12) and a rear wall (13) opposite one another, and two side walls (14, 15) opposite one another; and a locking panel (20), which is at least partially glued to a first side wall (9) of the container (2) and has an upper edge (21), which is connected to a lower edge (22) of a second side wall (14) of the lid (4);

wherein the upper edge (21) of the locking panel (20) is connected to the lower edge (22) of the second side wall (14) by means of a first pre-weakened and tearable connection line (24), and wherein the locking panel (20) is glued to the first side wall (9) by means of a weak and detachable glue (23), which, in use, allows the locking panel (20) to be completely separated from the first side wall (9).

2. The pack (1) for smoking articles according to claim 1, wherein the locking panel (20) is at least partially glued to the first side wall (9) by means of a strong and inseparable glue (23) which, in use, does not allow the locking panel (20) to be separated from the first side wall (9).

3. A pack (1) for smoking articles compromising:

a group (17) of smoking articles; a wrap (16), which houses the group (17) of smoking articles;

a rigid container (2), which is cup-shaped, houses the wrap (16) and has: an open upper end (3), a lower wall (6) opposite the open upper end (3), a front wall (7) and a rear wall (8) opposite one another, and two side walls (9, 10) opposite one another;

a lid (4), which is cup-shaped, is hinged to the container (2) along a hinge (5) so as to rotate, relative to the container (2), between an open position and a closed position and has: an open lower end, an upper wall (11), a front wall (12) and a rear wall (13) opposite one another, and two side walls (14, 15) opposite one another; and a locking panel (20), which is at least partially glued to a first side wall (9) of the container (2) and has an upper edge (21), which is connected to a lower edge (22) of a second side wall (14) of the lid (4);

wherein the upper edge (21) of the locking panel (20) is connected to the lower edge (22) of the second side wall (14) by means of a first pre-weakened and tearable connection line (24);

wherein the locking panel (20) is at least partially glued to the first side wall (9) by means of a strong and inseparable glue (23) which, in use, does not allow the locking panel (20) to be separated from the first side wall (9), and wherein the locking panel (20) is made up of:

an upper removable portion (25), which has the upper edge (21) connected to the lower edge (22) of the second side wall (14) and is not glued to the first side wall (9); and a lower anchoring portion (26), which is glued to the first side wall (9); wherein each side wall (9, 10) of the container (2) comprises an inner panel (9", 10") and an outer panel (9', 10'), which overlap and are glued to one another; wherein each side wall (14, 15) of the lid (4) comprises an inner panel (14", 15") and an outer panel (14', 15'), which overlap and are glued to one another; and wherein the removable portion (25) of the locking panel (20) is connected to an outside surface of the outer panel (9') of the side wall (9) of the container (2).

4. The pack (1) for smoking articles according to claim 3, wherein the locking panel (20) has a second pre-weakened and tearable connection line (27), which divides the removable portion (25) from the anchoring portion (26).

5. The pack (1) for smoking articles according to claim 4, wherein the second pre-weakened and tearable connection line (27) forms an acute angle with the first pre-weakened and tearable connection line (24) and originates from the first pre-weakened and tearable connection line (24).

6. The pack (1) for smoking articles according to claim 3, wherein:

the first side wall (9) comprises an inner panel (9") and an outer panel (9'), which overlap and are glued to one another; and the locking panel (20) is connected to the outer panel (9') of the first side wall (9).

7. The pack (1) for smoking articles according to claim 3, wherein:

the first side wall (9) comprises an inner panel (9") and an outer panel (9'), which overlap and are glued to one another; the outer panel (9') of the first side wall (9) has a recess (32), which reproduces in negative the shape of at least part of the locking panel (20) and houses the locking panel (20) on the inside so that the locking panel (20) is coplanar to the outer panel (9'); and the locking panel (20) is glued to the inner panel (9') of the first side wall (9).

8. The pack (1) for smoking articles according to claim 7, wherein:

the locking panel (20) comprises: an upper removable portion (25), which has the upper edge (21) connected to the lower edge (22) of the second side wall (14) and is not glued to the first side wall (9); and a lower anchoring portion (26), which is glued to the first side wall (9); and the recess (32) reproduces in negative the shape of the anchoring portion (26).

9. The pack (1) for smoking articles according to claim 8, wherein the locking panel (20) has a pre-weakened and tearable connection line (27), which divides the connection portion from the anchoring portion (26).

10. A pack (1) for smoking articles comprising:

a group (17) of smoking articles; a wrap (16), which houses the group (17) of smoking articles;

a rigid container (2), which is cup-shaped, houses the wrap (16) and has: an open upper end (3), a lower wall (6) opposite the open upper end (3), a front wall (7) and a rear wall (8) opposite one another, and two side walls (9, 10) opposite one another;

a lid (4), which is cup-shaped, is hinged to the container (2) along a hinge (5) so as to rotate, relative to the container (2), between an open position and a closed position and has: an open lower end, an upper wall (11), a front wall (12) and a rear wall (13) opposite one another, and two side walls (14, 15) opposite one another; and a locking panel (20), which is at least partially glued to a first side wall (9) of the container (2) and has an upper edge (21), which is connected to a lower edge (22) of a second side wall (14) of the lid (4);

wherein the upper edge (21) of the locking panel (20) is connected to the lower edge (22) of the second side wall (14) in a permanent and inseparable manner.

11. The pack (1) for smoking articles according to claim 10, wherein the locking panel (20) is made up of:

an upper connection portion, which has the upper edge (21) connected to the lower edge (22) of the second side wall (14) and is not glued to the first side wall (9); and a lower anchoring portion (26), which is glued to the first side wall (9).

12. A pack (1) for smoking articles comprising:

a group (17) of smoking articles; a wrap (16), which houses the group (17) of smoking articles;

a rigid container (2), which is cup-shaped, houses the wrap (16) and has: an open upper end (3), a lower wall (6) opposite the open upper end (3), a front wall (7) and a rear wall (8) opposite one another, and two side walls (9, 10) opposite one another;

a lid (4), which is cup-shaped, is hinged to the container (2) along a hinge (5) so as to rotate, relative to the container (2), between an open position and a closed position and has: an open lower end, an upper wall (11), a front wall (12) and a rear wall (13) opposite one another, and two side walls (14, 15) opposite one another; and a locking panel (20), which is at least partially glued to a first side wall (9) of the container (2) and has an upper edge (21), which is connected to a lower edge (22) of a second side wall (14) of the lid (4);

wherein the locking panel (20) has a holding tab (28), which projects from the rear wall (8) of the container (2).

13. The pack (1) for smoking articles of claim 12, wherein:

the locking panel (20) has at least one pre-weakened and tearable connection line (24, 27), which is made up of an alternation of through cuts and whole portions; and the through cuts extend along 40-60% of a total length of the pre-weakened and tearable connection line (27).

14. A pack (1) for smoking articles comprising:

a group (17) of smoking articles;

a wrap (16), which houses the group (17) of smoking articles;

a rigid container (2), which is cup-shaped, houses the wrap (16) and has: an open upper end (3), a lower wall (6) opposite the open upper end (3), a front wall (7) and a rear wall (8) opposite one another, and two side walls (9, 10) opposite one another; and a lid (4), which is cup-shaped, is hinged to the container (2) along a hinge (5) so as to rotate, relative to the container (2), between an open position and a closed position and has: an open lower end, an upper wall (11), a front wall (12) and a rear wall (13) opposite one another, and two side walls (14, 15) opposite one another;

wherein:

each side wall (9, 10) of the container (2) comprises an inner panel (9", 10") and an outer panel (9', 10'), which overlap and are glued to one another;

each side wall (14, 15) of the lid (4) comprises an inner panel (14", 15") and an outer panel (14', 15'), which overlap and are glued to one another; and a pre-weakened and tearable connection line (33) directly joins the inner panel (14") of a side wall (14) of the lid (4) to the inner panel (9") of a side wall (9) of the container (2);

wherein the pre-weakened and tear able connection line (33) has a larger length of whole portions in an area close to the hinge (5) and has a smaller length of whole portions in an area away from the hinge (5).

15. A pack (1) for smoking articles comprising:

a group (17) of smoking articles;

a wrap (16), which houses the group (17) of smoking articles; a rigid container (2) which is cup-shaped, houses the wrap (16) and has: an open upper end (3), a lower wall (6) opposite the open upper end (3), a front wall (7) and a rear wall (8) opposite one another, and two side walls (9, 10) opposite one another;

a lid (4), which is cup-shaped, is hinged to the container (2) along a hinge (5) so as to rotate, relative to the container (2), between an open position and a closed position, and has: an open lower end, an upper wall (11), a front wall (12) and a rear wall (13) opposite one another, and two side walls (14, 15) opposite one another;

a locking panel (34) which is connected to an upper edge of the front wall (7) of the container (2) along a pre-weakened and tearable connection line (35) and is glued to an inner surface of the front wall (12) of the lid (4); and one single locking panel (34), which is arranged at the center and has the shape of an isosceles trapezium, in which the smaller base is arranged in the area of the upper edge of the front wall (7) of the container (2), namely in the area of the pre-weakened and tearable connection line (35).

* * * * *